United States Patent [19]

Neighbors

[11] Patent Number: 5,044,681

[45] Date of Patent: Sep. 3, 1991

[54] DOOR STOP

[76] Inventor: Carey W. Neighbors, 1402 15th Pl., Alexander City, Ala. 35010

[21] Appl. No.: 657,403

[22] Filed: Feb. 19, 1991

[51] Int. Cl.[5] ..... E05C 19/18

[52] U.S. Cl. ..... 292/288; 16/319; 292/DIG. 17

[58] Field of Search ..... 16/319; 292/288, 289, 292/358, 343, 300, DIG. 17

[56] References Cited

U.S. PATENT DOCUMENTS 1,616,265 2/1927 Kroehling ..... 292/288 X
2,762,644 9/1956 Polos ..... 292/288
4,831,688 5/1989 Deininger ..... 292/288 X

*Primary Examiner*—Richard E. Moore
*Attorney, Agent, or Firm*—Leon Gilden

[57] ABSTRACT

A door stop arrangement is directed between a door frame and a door for positioning upon a hinge to effect maintaining the door in an opened configuration. The door stop includes a "V" shaped body defined by a joinder line, with the "V" shaped body including an "L" shaped handle extending rearwardly of the body bisecting an acute included angle between the plates defining the body to permit positioning of the "L" shaped handle overlying the hinge when the plates are directed between the door and door frame.

5 Claims, 4 Drawing Sheets

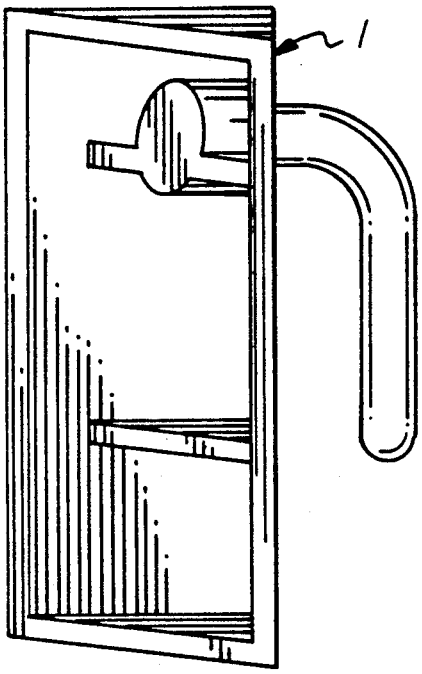
Fig 1
PRIOR ART
Fig 2
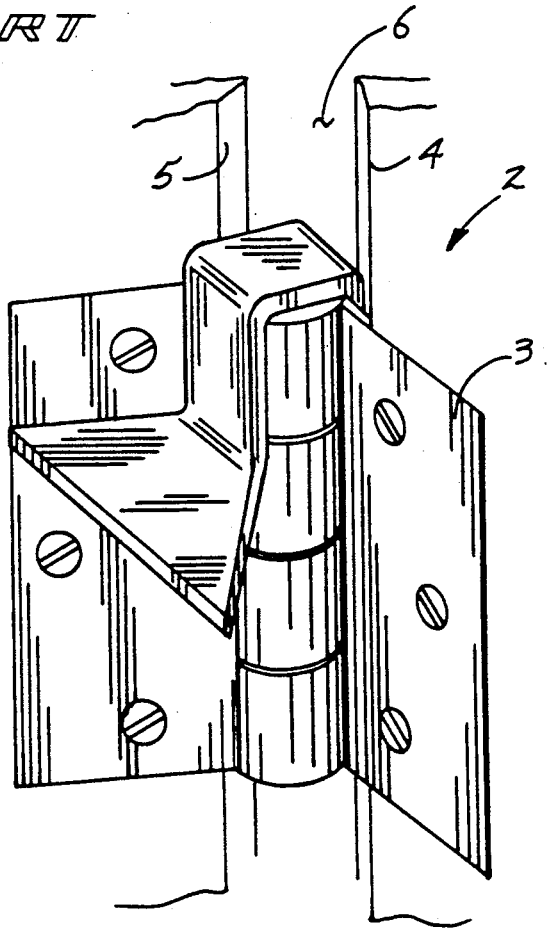
PRIOR ART 10
11a
13
14
15
11
16
12a
3
17
12

11a
14
11
13
12
16
15
12a

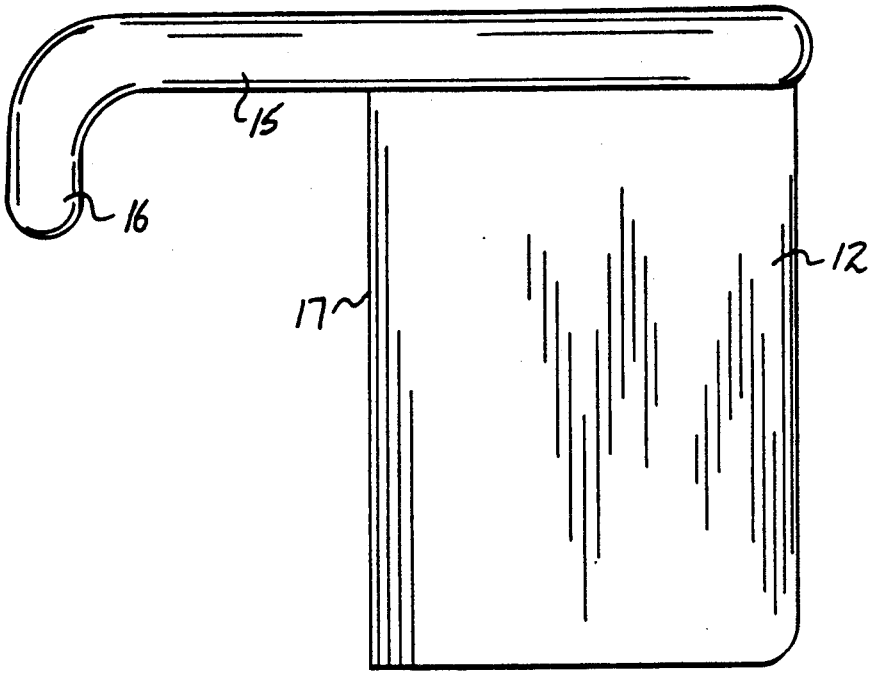
Fig 5
Fig 6
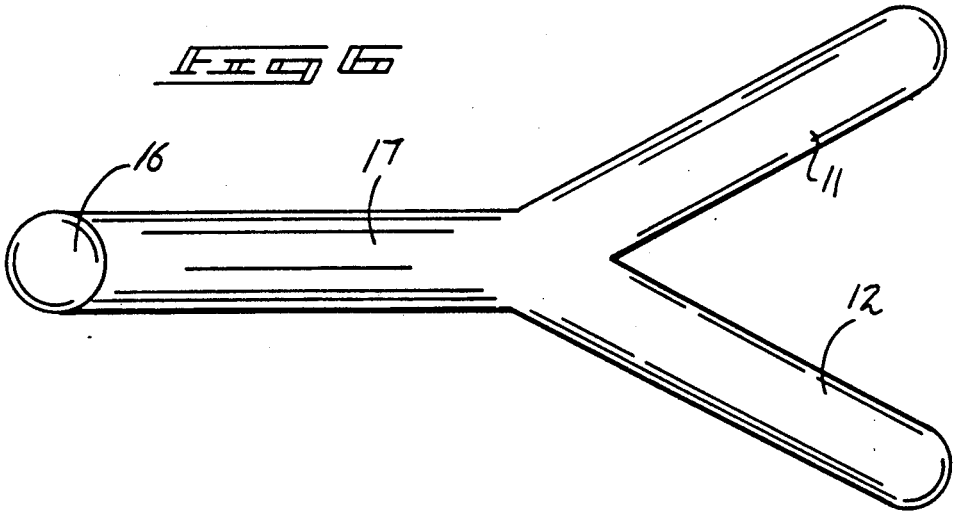

DOOR STOP

BACKGROUND OF THE INVENTION

1. Field of the Invention

The field of invention relates to door stops, and more particularly pertains to a new and improved door stop wherein the same is arranged for positioning between a door and door frame during use.

2. Description of the Prior Art

Door stop apparatus of various types have been utilized in the prior art to maintain a door configuration, and particularly for use in emergency situations by a fireman, police, and the like. Prior art examples of door stop apparatus may be found in U.S. Pat. No. 4,831,688 to Deininger wherein the door stop includes a "U" shaped body positioned to overlie the central cylindrical bolt portion of a hinge between the door and door frame.

Design patent U.S. Pat. No. Des 244,830 to Tulak; Design patent U.S. Pat. Des. 302,939 to Ruskin; Design patent U.S. Pat. No. Des. 242,985 to Sasgen; and design patent U.S. Pat. No. Des. 286,015 to Johnson are examples of door stop apparatus utilized in the prior art.

As such, it may be appreciated that there continues to be a need for a new and improved door stop as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of door stops now present in the prior art, the present invention provides a door stop wherein the same is arranged for positioning between the door and door frame and further provided to accommodate flexure between first and second plates defined in a door stop to minimize damage to the door frame structure during use. As such, the general purpose of the present invention, which will be described subsequently in greater detail, is to provide a new and improved door stop which has all the advantages of the prior art door stops and none of the disadvantages.

To attain this, the present invention provides a door stop arrangement directed between a door frame and a door for positioning upon a hinge to effect maintaining the door in an opened configuration. The door stop includes a "V" shaped body defined by a joinder line, with the "V" shaped body including an "L" shaped handle extending rearwardly of the body bisecting an acute included angle between the plates defining the body to permit positioning of the "L" shaped handle overlying the hinge when the plates are directed between the door and door frame.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved door stop which has all the advantages of the prior art door stops and none of the disadvantages.

It is another object of the present invention to provide a new and improved door stop which may be easily and efficiently manufactured and marketed.

It is a further object of the present invention to provide a new and improved door stop which is of a durable and reliable construction.

An even further object of the present invention is to provide a new and improved door stop which is susceptible of a low cost of manufacture with regard to both materials and labor, and which accordingly is then susceptible of low prices of sale to the consuming public, thereby making such door stop economically available to the buying public.

Still yet another object of the present invention is to provide a new and improved door stop which provides in the apparatuses and methods of the prior art some of the advantages thereof, while simultaneously overcoming some of the disadvantages normally associated therewith.

Still another object of the present invention is to provide a new and improved door stop wherein the same is defined by a "V" shaped body to accommodate flexure between plates defining the "V" shaped body, and further including wing members mounted to the "V" shaped body to provide enhanced flexural accommodation of inadvertent positioning of a door relative to a door frame structure.

These together with other objects of the invention, along with the various features of novelty which characterize the invention, are pointed out with particularly in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art door stop.

FIG. 2 is an isometric illustration of a further example of a prior art door stop.

FIG. 5 is an orthographic side view of the instant invention.

FIG. 6 is an orthographic bottom view of the instant invention.

DESCRIPTION OF THE PREFERRED EMBODIMENT

Figure 3:
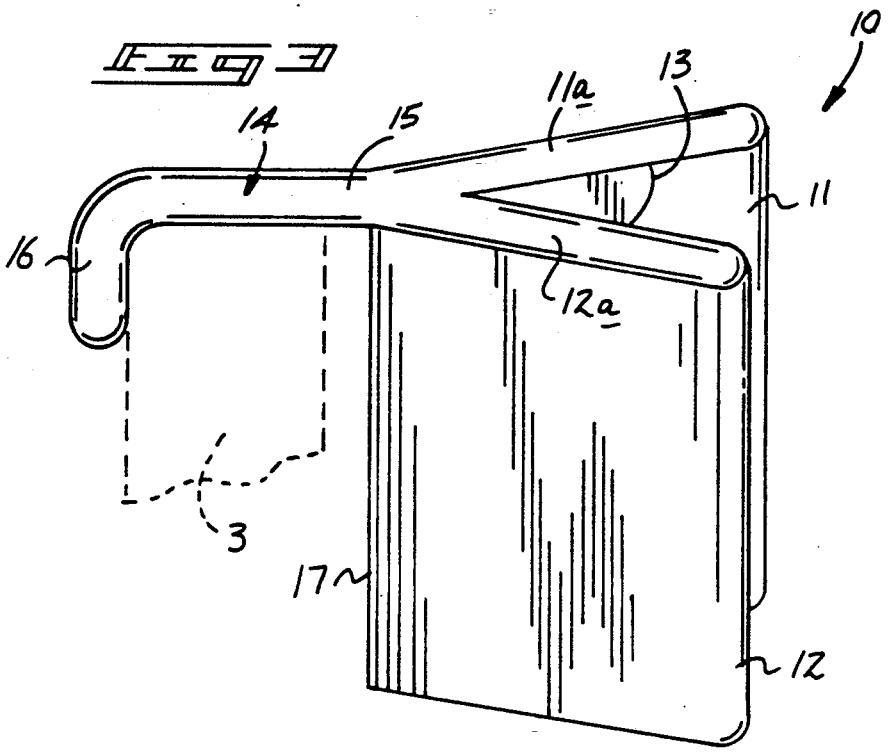
FIG. 3 is an isometric illustration of the instant invention.
Figure 4:
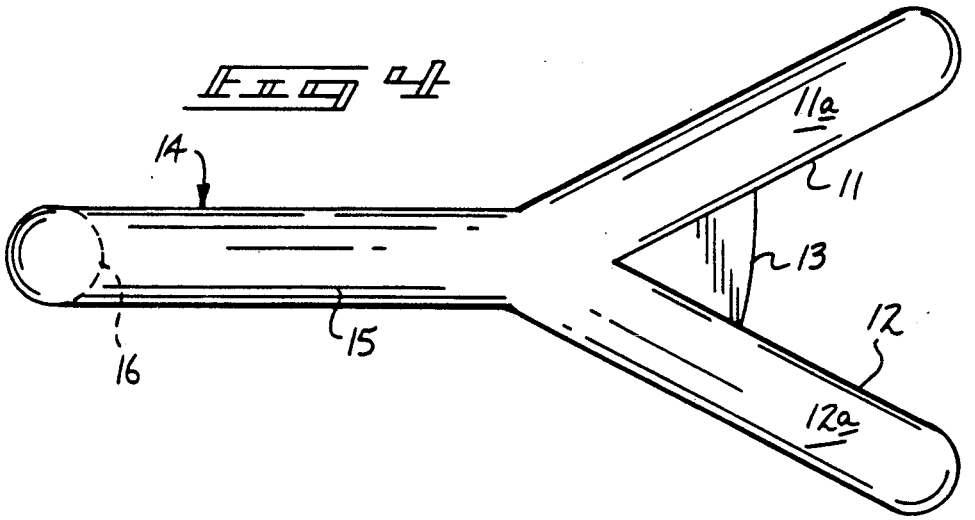
FIG. 4 is a top orthographic view of the instant invention.

With reference now to the drawings, and in particular to FIGS. 1 to 8 thereof, a new and improved door stop embodying the principles and concepts of the present invention and generally designated by the reference numeral 10 will be described.

FIG. 1 illustrates a prior art door stop, as presented in design patent U.S. Pat. No. 286,015.

FIG. 2 sets forth a prior art door stop apparatus 2 presented in U.S. Pat. No. 4,831,688, wherein the "U" shaped body of the apparatus is positioned overlying a main body portion of a hinge 3 within a door gap 6 defined between a door frame 4 and a door 5.

More specifically, the door stop 10 of the instant invention essentially comprises a first plate 11 mounted to a second plate 12 along a joinder line 17 defining a "V" shaped body. The respective first and second plates define respective first and second top surfaces 11*a* and 12*a* and should be noted the plates are coextensive relative to one another of equal configuration. An acute angle 13 is defined between the first and second plates, wherein an "L" shaped support leg 14 extends rearwardly relative to the "V" shaped body and bisects the angle 13 in its rearward extent, and includes a first leg 15 that is coplanar with the respective first and second top surfaces 11*a* and 12*a*. A second leg 16 orthogonally joined to the first leg 15 extends parallel to the joinder line 17. In this manner, the support leg 14 is positional overlying a hinge central body portion 3, in a manner as illustrated in the prior art structure of FIG. 2, with the "V" shaped plates 11 and 12 extending within the door gap 6 in use.

Figure 7:
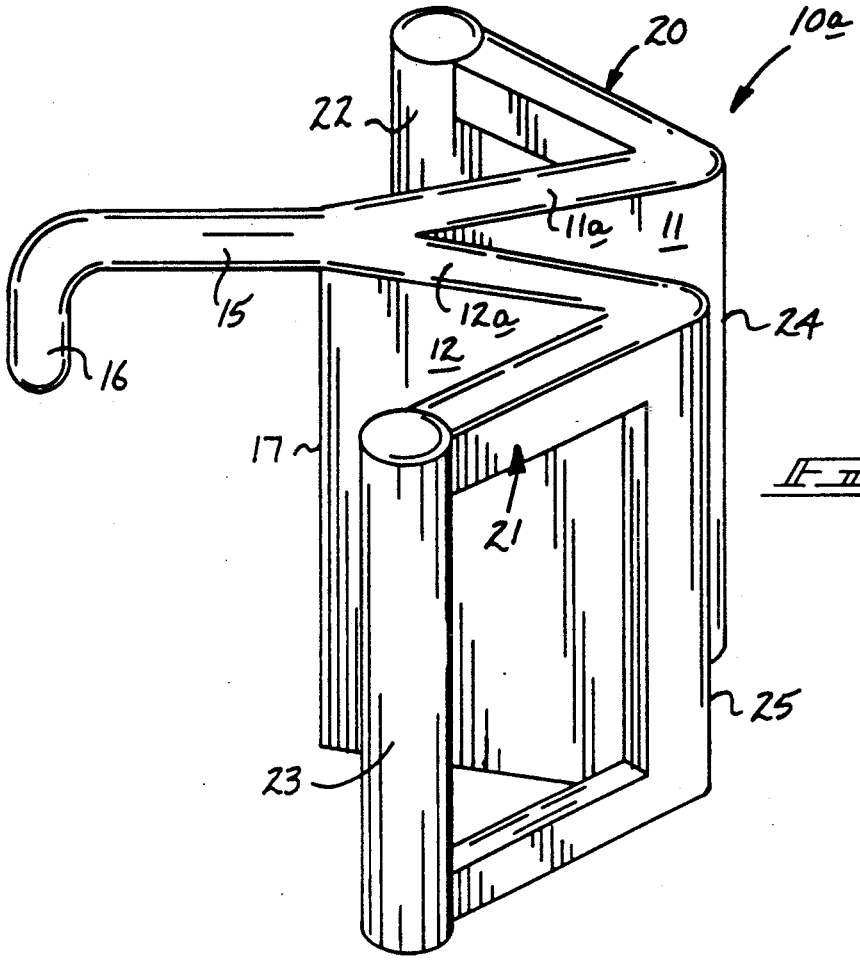
FIG. 7 is an isometric illustration of a modified door stop utilized by the instant invention.
Figure 8:
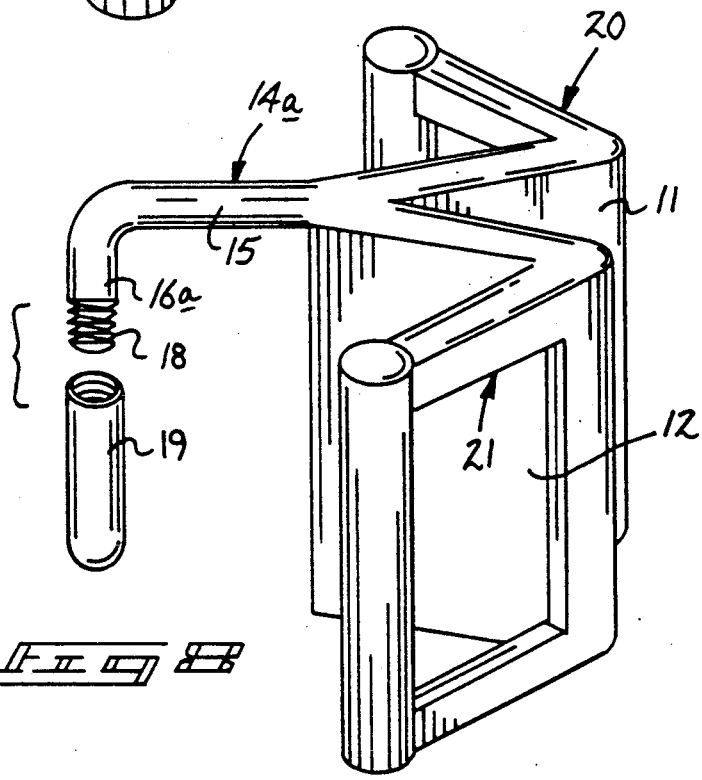
FIG. 8 is an isometric illustration of the modified door stop of the instant invention utilizing partial magnetic body tube.

FIGS. 7 and 8 illustrate the use of a modified door stop 10, wherein a threaded shank 18 is formed at a lower terminal end of a modified second leg 16*a* of a modified "L" shaped leg 14*a*. The threaded shank 18 threadedly receives an internally threaded magnetic tube 19 to enhance mounting and magnetic attraction of the "L" shaped leg to the hinge. It should be further noted that a predetermined degree of flexure is accommodated by the "V" shaped body and the joinder line 17 which functions as means to maintain the "V" shaped body in an extended configuration and permits a certain degree of compression between the first and second plates. The modified door stop 10*a* includes a respective first and second wing 20 and 21 to define acute angles between the respective first and second plates 11 and 12 and defines a generally "W" shaped body, including respective first and second abutment rods 22 and 23 mounted at opposed vertical end portions of the first and second wings, wherein the abutment rods are arranged parallel to the joinder line 17. The "W" shaped body accommodates a greater degree of flexure in association within the door gap 6.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A door stop comprising, in combination, a first plate mounted to a second plate arranged coextensively therewith defining an acute angle therebetween, wherein the first and second plates are joined together along a common joinder line, and the first plate includes a first plate top surface and a second plate defines a second plate top surface, wherein the first plate top surface and the second plate top surface are coplanar relative to one another, and an "L" shaped support leg is fixedly mounted relative to the first plate and second plate at a junction defined by the joinder line and the first plate top surface and the second plate top surface.

2. An apparatus as set forth in claim 1 wherein the "L" shaped support leg includes a first leg orthogonally mounted to the junction, and a second leg orthogonally mounted to the first leg spaced from the junction, wherein the second leg is arranged parallel to the joinder line.

3. An apparatus as set forth in claim 2 wherein the second leg includes a lower threaded shank, and an internally threaded magnetic tube is threadedly securable to the threaded shank to enhance securement of the "L" shaped leg to a door hinge.

4. An apparatus as set forth in claim 3 wherein the first plate includes a first wing member mounted thereto defining a further acute angle between the first wing and the first plate, and the second plate includes a second wing mounted to the second plate defining the further acute angle between the second wing and the second plate, wherein the first plate, the second plate, the first wing, and the second wing define a "W" shaped body, and the "W" shaped body accommodates flexure to normally bias the "W" shaped body in an extended configuration.

5. An apparatus as set forth in claim 4 wherein the first wing includes a first abutment rod arranged parallel to the joinder line and the second wing includes a second abutment rod arranged parallel to the joinder line.

* * * * *